US006126551A

United States Patent [19]

Martin

[11] Patent Number: 6,126,551

[45] Date of Patent: Oct. 3, 2000

[54] RINK AND CORRIDOR RECREATIONAL FACILITY

[76] Inventor: Robert A. Martin, 9530 Tramway Blvd., NE., Albuquerque, N. Mex. 87122

[21] Appl. No.: 09/089,567

[22] Filed: Jun. 3, 1998

Related U.S. Application Data

[60] Provisional application No. 60/048,529, Jun. 3, 1997.

[51] Int. Cl.[7] ..... A63C 19/10

[52] U.S. Cl. ..... 472/92; 52/6; 472/90

[58] Field of Search ..... 472/92, 90, 91; 62/235; 52/6, 7, 8, 9, 10

[56] References Cited

U.S. PATENT DOCUMENTS

| | | | |
|---|---|---|---|
| 2,766,046 | 10/1956 | Skrainka . | |
| 3,107,400 | 10/1963 | Anderson . | |
| 3,379,031 | 4/1968 | Lewis, Jr. . | |
| 3,487,595 | 1/1970 | Schumann | 52/6 |
| 3,990,260 | 11/1976 | Eustis . | |
| 4,038,834 | 8/1977 | Roberts . | |
| 4,301,788 | 11/1981 | Hummel . | |
| 4,497,483 | 2/1985 | Ahlgren . | |
| 5,331,826 | 7/1994 | Stockhaus et al. | 62/235 |
| 5,536,411 | 7/1996 | Blades . | |
| 5,643,094 | 7/1997 | Macri et al. | 472/92 |
| 5,709,099 | 1/1998 | Blades et al. | 62/235 |

*Primary Examiner*—Kien T. Nguyen
*Attorney, Agent, or Firm*—Peacock, Myers & Adams

[57] ABSTRACT

A recreational facility with multiple rinks and connecting corridors. Moveable partitions allow segregation of rinks and corridors. Segregated rinks and corridors are usable simultaneously for a variety of recreational and competitive activities.

19 Claims, 14 Drawing Sheets

RINK AND CORRIDOR RECREATIONAL FACILITY

CROSS-REFERENCE TO RELATED APPLICATIONS

This application claims the benefit of the filing of U.S. Provisional Patent Application Serial No. 60/048,529, entitled Skating Arena, filed on Jun. 3, 1997, and the specification thereof is incorporated herein by reference.

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention (Technical Field)

The present invention relates to recreational facilities.

2. Background Art

Until recent years recreational facilities with rinks, especially ice rinks, were few in number and found mostly in states bordering the northern extremities of the United States. Most of these facilities operated on a seasonal basis, attracting a seasonal crowd. Many of these facilities were government owned and operated.

Recreational facilities with rinks suffer from a common problem; due to size most facilities feature only one rink. Recently, a few double rink facilities have been built to handle the increased participation stemming from the Olympics and television publicity. Many of the new double rink facilities have been located in existing warehouse buildings due to the size of the building needed and cost to design and build a brand new facility.

Recreational facilities with rinks, especially ice rinks, are dependent on three major venues for revenue, plus a number of minor ones. The three venues are public entertainment skating, ice hockey, and figure skating.

These venues are all incompatible, i.e., require exclusive use of a rink. When one venue occupies the rink, other venues are "locked out." As a facility gains success, these events typically experience an increase in duration. A major hockey tournament or figure skating competition can last several days. In addition, venues often require the primetime hours from 5 PM to 10 PM due to the school and work schedules of their participants.

These two problems are stifling to the growth of rink-based recreational facility venues. They can only be solved by additional surfaces and/or rinks.

Additionally, public skating, the highest revenue generator, is dependent on skater enjoyment so that each skater returns as often as possible. Skating in the same oval, over and over again, loses its enjoyment too quickly. Only a change of directions is possible to break skater monotony. As a result, frequent visits by non-dedicated skaters are difficult to maintain. There is also a need to enhance the aesthetic presentation of recreational facilities to increase customer enjoyment.

The following patents disclose subject matter related to ice rink configurations. U.S. Pat. No. 4,497,483, entitled "Device for dividing ice-hockey rinks," to Ahlgren, discloses a device for dividing an ice hockey rink into at least two smaller rink parts. U.S. Pat. No. 4,038,834, entitled "Ice skating arena, to Roberts, discloses a plurality of ice rinks and interconnecting bridging sections having movable barriers. U.S. Pat. No. 3,379,031, entitled "Artificial ice rink employing modular units," to Lewis, discloses individual ice module units that may be linked to form a larger ice surface. U.S. Pat. No. 2,766,046, entitled "Combination swimming pool, skating rink and exhibition floor," to Skrainka, discloses an arena that can be used alternately as a swimming pool, a skating rink, or an exhibition center.

The following patents disclose subject matter related to energy efficiency. U.S. Pat. No. 5,536,411, entitled "Water and energy recovery process for an ice rink," to Blades, discloses a water and energy recovery process for an ice rink. U.S. Pat. No. 4,301,788, entitled "Solar water reclamation system," to Hummel, discloses an energy saving system for reclaiming waste water from ice shavings wherein waste water melt is sprayed upon the ice shavings to promote further melting. U.S. Pat. No. 3,990,260, entitled "Low-temperature dehumidifier," to Eustis, discloses a low temperature dehumidifier for use with ice rink enclosures.

The following patent relates to movable partitions to divide rooms. U.S. Pat. No. 3,107,400, entitled "Movable wall partition," to Anderson, discloses movable wall sections to increase or decrease the size of a room.

None of the aforementioned references disclose a system of corridors and rinks wherein the corridors comprise stand-alone, usable surfaces for ice skating and other activities.

SUMMARY OF THE INVENTION (DISCLOSURE OF THE INVENTION)

The present invention includes a recreational facility comprising at least two rinks or arenas and at least one corridor connecting the rinks. The rink surfaces and corridor surfaces are composed of water, ice, snow, flooring, natural materials, synthesized materials, and/or manufactured materials. The rinks have shapes including rectangular, circular, oval, square, and polygon. The preferred embodiments of the recreational facility include two Olympic configured rinks with connecting corridors. The primary purpose of the corridors is to connect the rinks, allow access to one or more rinks and direct user flow. The corridors may also serve another purpose, such as a place for training skills. As such, the corridor may house spotting belts, harnesses, runners, spotting rigs, foam pits, water pits, cushioned pits, video cameras, tracks, mechanical arms, ropes and the like. Corridors typically have a length of at least 10 feet. Corridors may have a cross section that is rectangular, circular, oval, semi-circular, U-shaped, polygon, and/or V-shaped. Such a variety of shapes suits the needs of a diverse group of potential clients.

Dasherboards surrounding the rinks and corridors are desirable. Dasherboards comprising movable sections or gates allow interconnection between corridors and rinks. In the preferred embodiment, the dasherboard gates are movably positionable. Such positioning is accompanied by pneumatics, hydraulic pistons, electric motors, gasoline engines, propane engines, steam engines, manual labor, electromagnetic forces and the like. The movement is facilitated by at least one of the following: gears, pulleys, winches, cables, pistons, wheels, sliders, retractors, hinges, latches, and separators.

In a preferred embodiment, a central module is positioned between the rinks. Central modules having more than one level are preferable. The central module houses a variety of rooms, such as a lobby, locker room, concessions area, coat check room, emergency aid room, training room, restroom, storage room, fireplace room, viewing room, office, instructional room, theatre, audiovisual room, music room, meditation room, sauna, fitness center, steam room, kitchen, dining room, dormitory room, laundry room, supply room, ticket booth, telephone booth, communications room, computer room, autograph room, press area, etc.

Auxiliary structures may surround and are integrated with the recreational facility. Auxiliary structures serve a variety of functions such as housing for a Zamboni machine room, mechanical room, proshop, fitness center, maintenance room, training room, dormitory, kitchen, restaurant, concessions stand, store, storage room, entrance (e.g., multilevel entrance), ticket booth, theatre, classroom, viewing room, locker room, etc.

In the preferred embodiment, at least one auxiliary structure serves as a main entrance. Typically, a main entrance has doors, turnstiles, revolving doors, gates, stairways, poles, elevators, escalators, lifts, ramps and the like. If the central module has an upper level extending over a corridor, then the entrance serves as an access means to traverse the corridor. In this embodiment, the entrance has either individually or in combination a stairway, escalator, elevator, ramp, lift, or the like.

In the preferred embodiment, the recreational facility also has advertisements placed strategically within, to help generate revenue for the facility and to provide visual interest and information for the facility users.

Zamboni machines clean and resurface ice skating rinks; therefore, an auxiliary structure fashioned as a Zamboni machine room and fitted with a water reclamation system is desirable. A typical water reclamation system of the present invention entails use of a melting pit covered by a metal grate, a heating coil positioned in the melting pit, a spray system, a heated fluid supply, a pump, and a filter.

A primary object of the present invention is to provide recreational facility having multiple rinks, connecting corridors, and user facilities.

A primary advantage of the present invention is a high degree of operational flexibility and multiple use for a recreational facility.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

Figure 1:
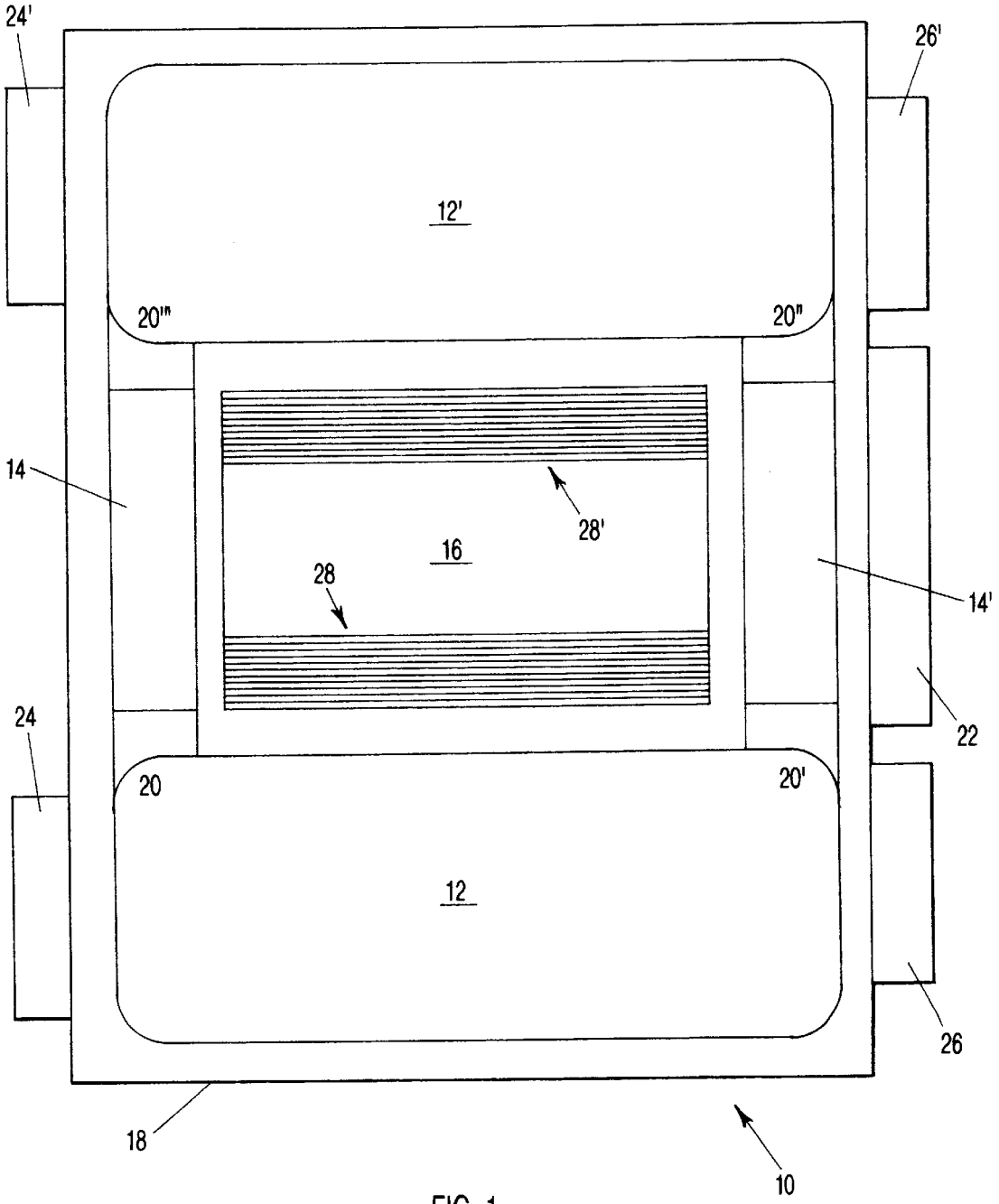
FIG. 1 is a diagram of the preferred rink and corridor configuration of the present invention.

The preferred embodiment of recreational facility 10 is shown in FIG. 1. Referring to FIG. 1, recreational facility 10 comprises two rinks 12, 12' with two connecting corridors 14, 14'. Corridors 14, 14' open and close at gates 20, 20', 20", 20"'. Open gates create a large rink comprising rink surfaces 12, 12' and corridor surfaces 14, 14'. Central module 16 lies between rinks 12, 12' and corridors 14, 14'. Central module 16 preferably comprises spectator-seating 28, 28'. Central module 16 further comprises, for example, lobby, locker room, concessions area, coat check room, emergency aid room, training room, restroom, storage room, fireplace room, viewing room, offices, instructional room, theatre, audiovisual room, music room, meditation room, sauna, fitness center, steam room, kitchen, dining room, dormitory room, laundry room, supply room, ticket booth, telephone booth, communications room, computer room, autograph room, press area, and the like.

Recreational facility 10 is housed within an exterior structure 18. Exterior structure 18 comprises adjustable modules to allow changing of structure configuration. Adjacent to exterior structure 18 are front main auxiliary structure 22, rear auxiliary structures 24, 24' and front auxiliary structures 26, 26'. Auxiliary structure 22 comprises an entrance to central module 16. Auxiliary structures 24, 24', 26, 26' comprise at least one of the following, for example, Zamboni machine room, mechanical room, proshop, fitness center, maintenance room, training room, dormitory, kitchen, restaurant, concessions stand, store, storage room, entrance (e.g., multilevel entrance), ticket booth, theatre, classroom, viewing room, locker room, merchandise shop, and the like.

Figure 2A:
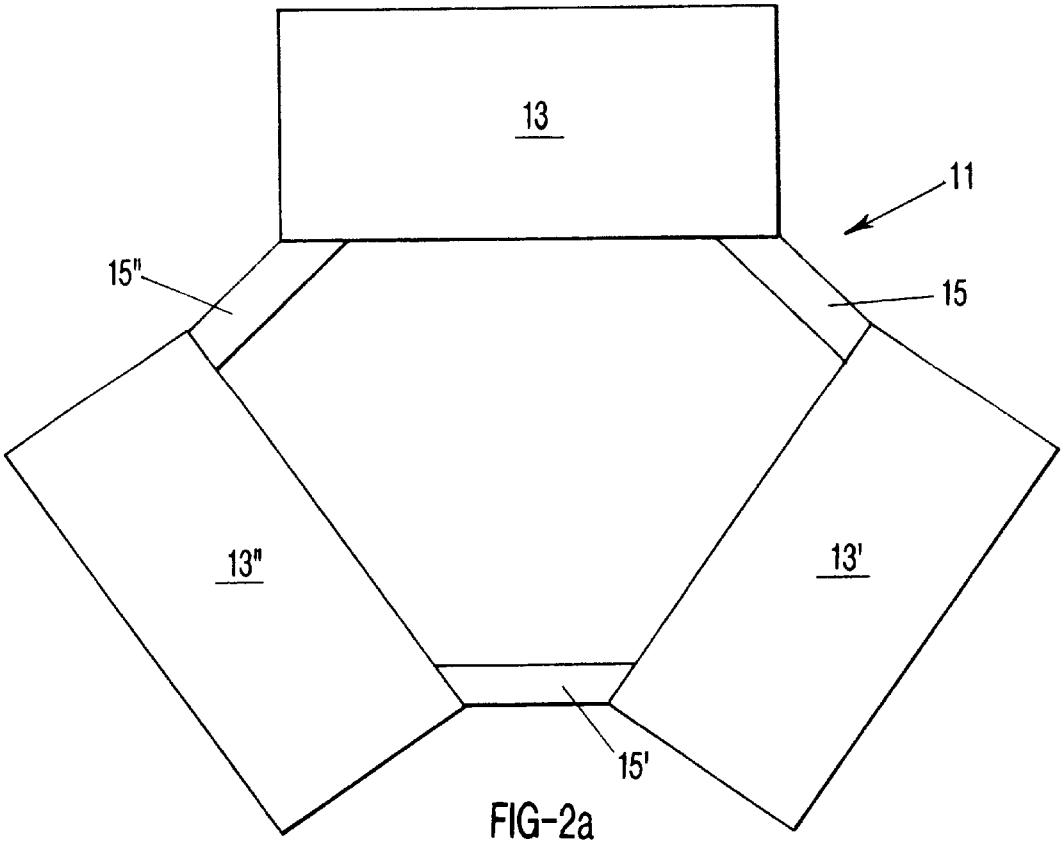
FIGS. 2*a–b* are diagrams of alternative rink and corridor embodiments of the present invention.
Figure 2B:
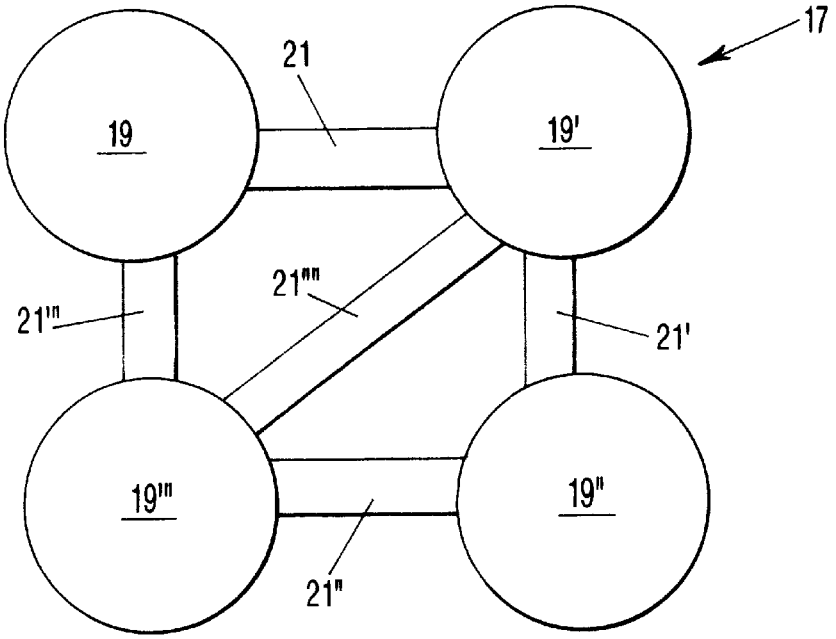
Figure 2C:
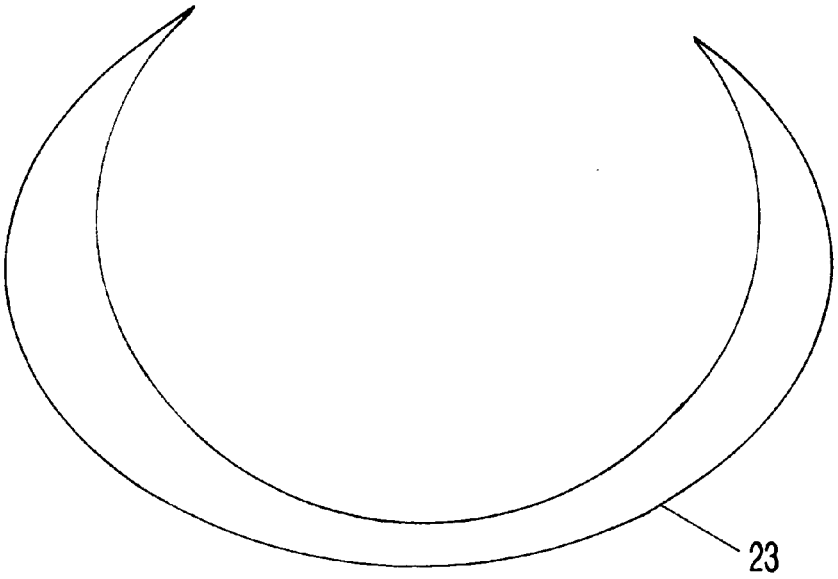
FIG. 2*c* is a diagram of an alternative corridor cross section of the present invention.
Figure 2C:
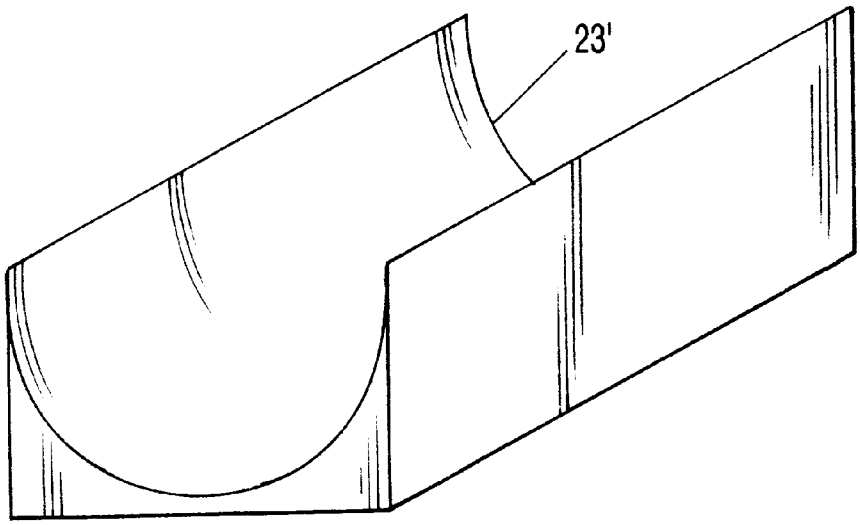

FIGS. 2*a–c* illustrates alternative embodiments of the present invention. FIG. 2*a* shows recreational facility 11, comprising three rectangular shaped rinks 13, 13', 13" with three connecting corridors 15, 15', 15". FIG. 2*b* shows recreational facility 17 comprising four circular rinks 19, 19', 19", 19"' and five connecting corridors 21, 21', 21", 21"', 21"". As shown in FIGS. 2*a–c*, the rink arena may comprise a variety of surface configurations such as rectangular, square, circular, oval, and the like.

The rink surface preferably comprises one level, however multiple level rink and corridor embodiments are within the scope of the present invention.

The corridors open to create large rinks or close to form smaller rinks. A variety of configurations and embodiments for the recreational facility of the present invention enhance enjoyment for skaters, swimmers, snowboarders, skateboarders, cross-country skiers, and other individuals and groups seeking recreational enjoyment. Skaters include ice skaters, professional skaters, ice hockey players, non-ice hockey players, roller skaters and roller blade skaters. For example, as shown in FIG. 2*c*, an alternative corridor embodiment, corridors configured as half-pipes or the like, corridor cross-section 23 and corridor perspective 23', depending on the surface chosen, allow for participation by skateboarders, snowboarders, roller skaters, stunt bikers, sled riders, lugers, ice climbers, rock climbers, and others that seek a curved sloping surface. Additional features, such as spotting rigs and the like, located in the corridors enable training of special skills on such curved surfaces.

Figure 3:
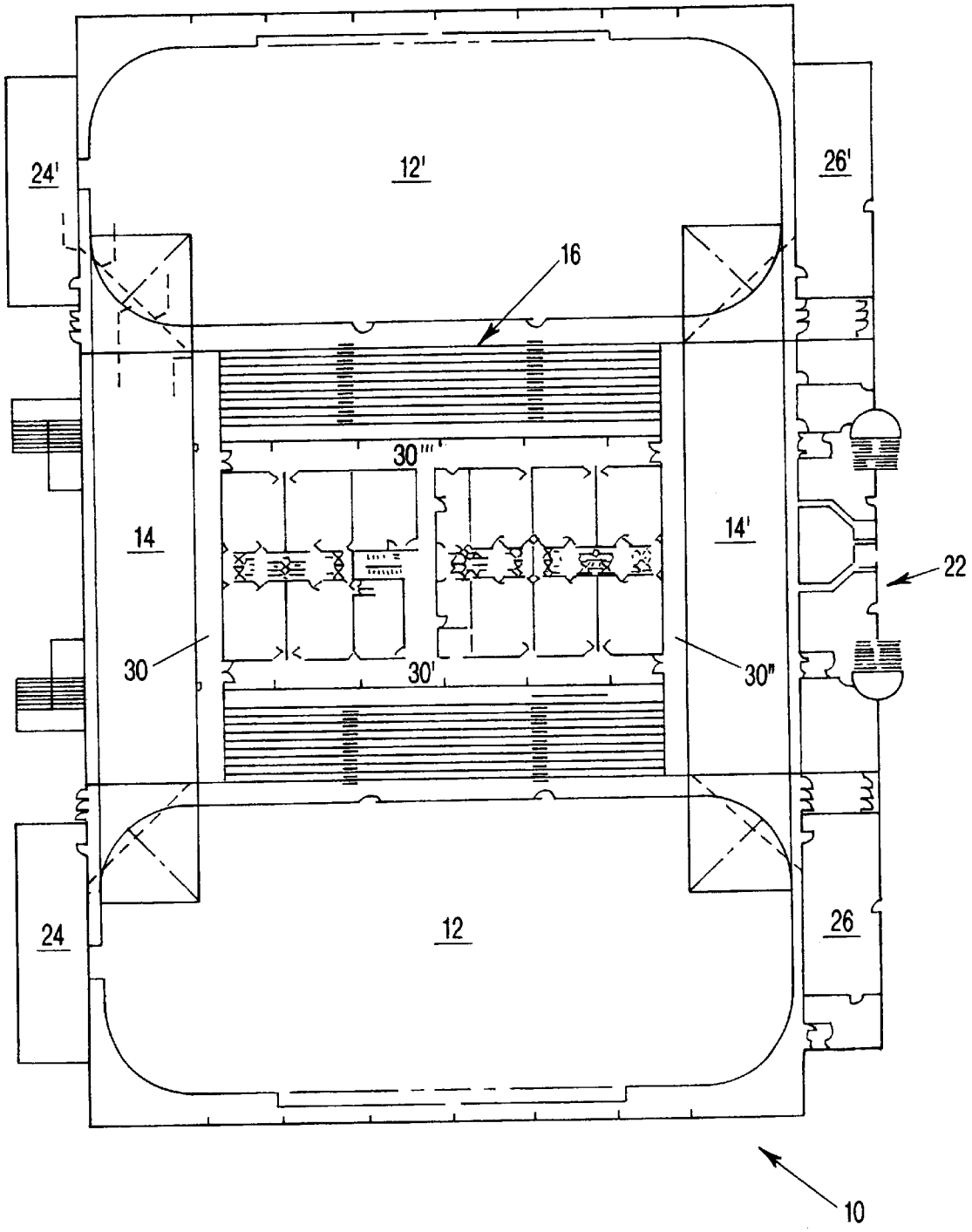
FIG. 3 is a diagram of a lower level of the preferred rink and corridor embodiment of the present invention.

A lower level of the preferred embodiment of recreational facility 10 is shown in FIG. 3. Auxiliary structure 24 serves as a Zamboni machine room while auxiliary structure 24' serves as another Zamboni machine room or a mechanical room. Auxiliary structure 26 serves as a pro shop while auxiliary structure 26' serves as a fitness center. Auxiliary structure 22 serves as an entrance to central module 16. Entrance to central module 16 occurs above the lower level on an upper level of central module 16. Lower level of central module 16 comprises a large room or a variety of individual rooms including, but not limited to, locker rooms, gym rooms, restrooms, storage rooms, maintenance rooms, training room, rehabilitation room, medical aid office, and the like. These rooms are accessible by hallways 30, 30', 30", 30"'.

Figure 4:
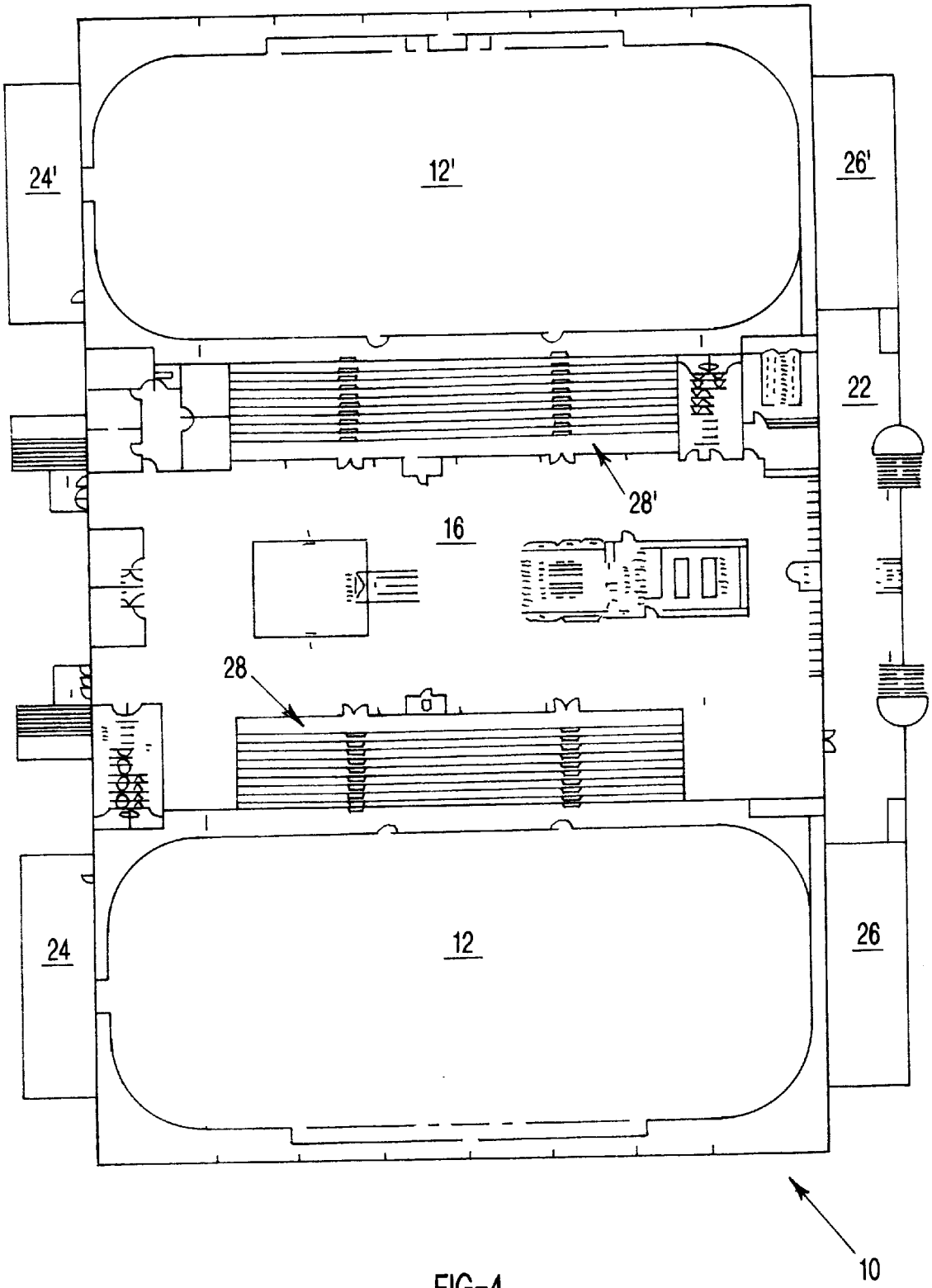
FIG. 4 is a diagram of an upper level of the preferred rink and corridor embodiment of the present invention.

An upper level of the preferred embodiment of recreational facility 10 is shown in FIG. 4. Upper level of central module 16 comprises a lobby having a variety of areas for functions associated with operation of the recreational facility. Upper level of central module 16 comprises at least one functional area selected from among the following: party area, meeting area, ticket purchase area, viewing area, emergency aid area, phone area, rest area, fireplace area, clothing and other gear check area, storage area, and the like. Access to seating 28, 28' is available via the upper level of central module 16. Stairways or other people access-ways connect lower level of entry structure 22 to upper level of entry structure 22 and subsequently upper level of central module 16.

Figure 5A:
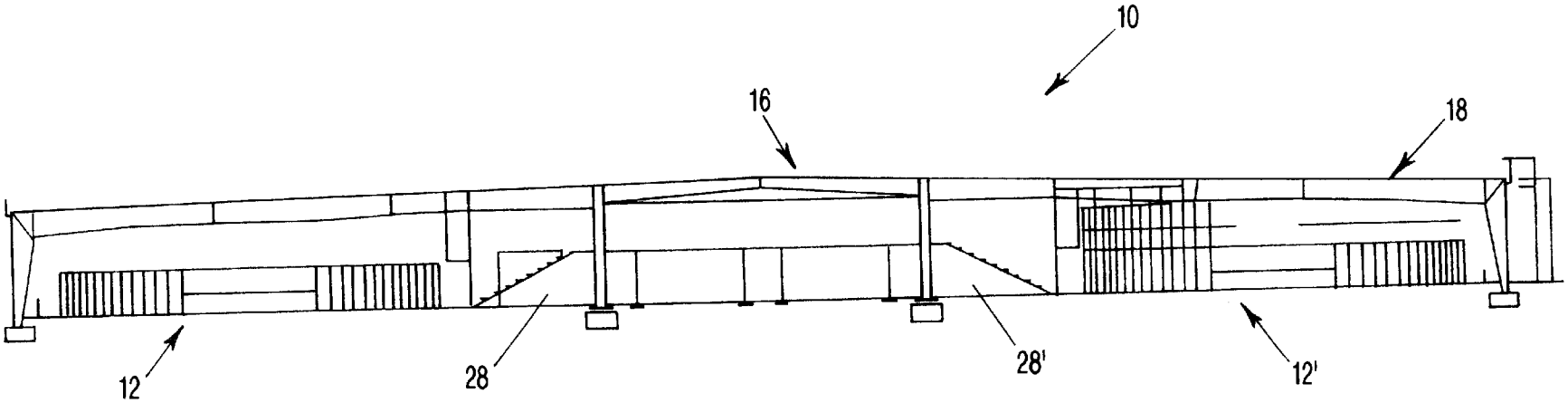
FIG. 5*a* is a transverse cross section view of the preferred rink and corridor embodiment of the present invention.
Figure 5B:
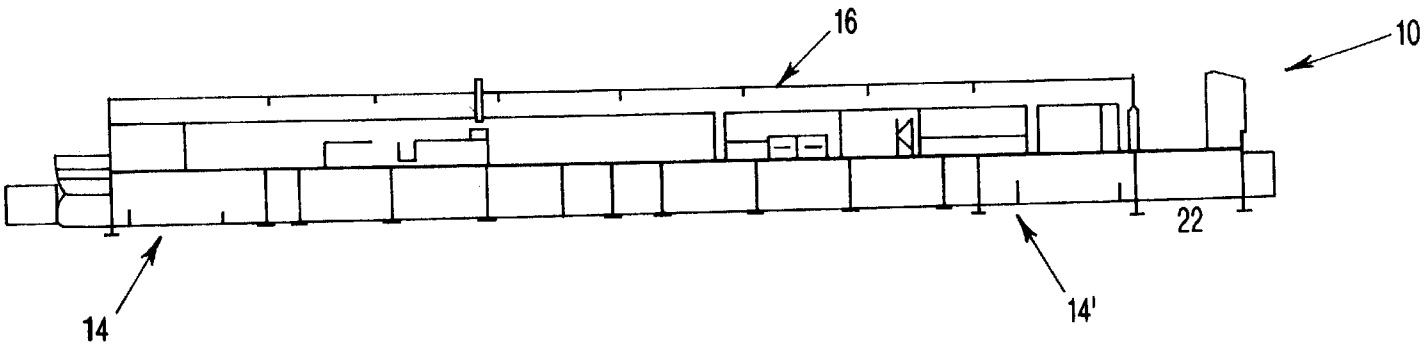
FIG. 5*b* is a longitudinal cross section view of the preferred rink and corridor embodiment of the present invention.

A transverse cross sectional view of a preferred embodiment of recreational facility 10 is shown in FIG. 5*a*. Rinks 12, 12' flank central module 16. Seating areas 28, 28' descend from upper level of central module 16 to lower level of central module 16. Surrounding rinks 12, 12' are dasherboards 32, 32'. Movable dasherboard sections 34, 34' lie adjacent to corridors 14, 14'. Rink 12' depicts movable dasherboard section 34' in an open position allowing access to corridor 14. A longitudinal cross sectional view through central module 16 of a preferred embodiment of recreational facility 10 is shown in FIG. 5*b*. Auxiliary structure 22 facilitates access to upper level of central module 16. Corridor 14 lies adjacent to auxiliary structure 22 and within main structure 18. At opposing end of central module 16, a stairway facilitates egress upon termination of events or in case of emergency situations.

Figure 6:
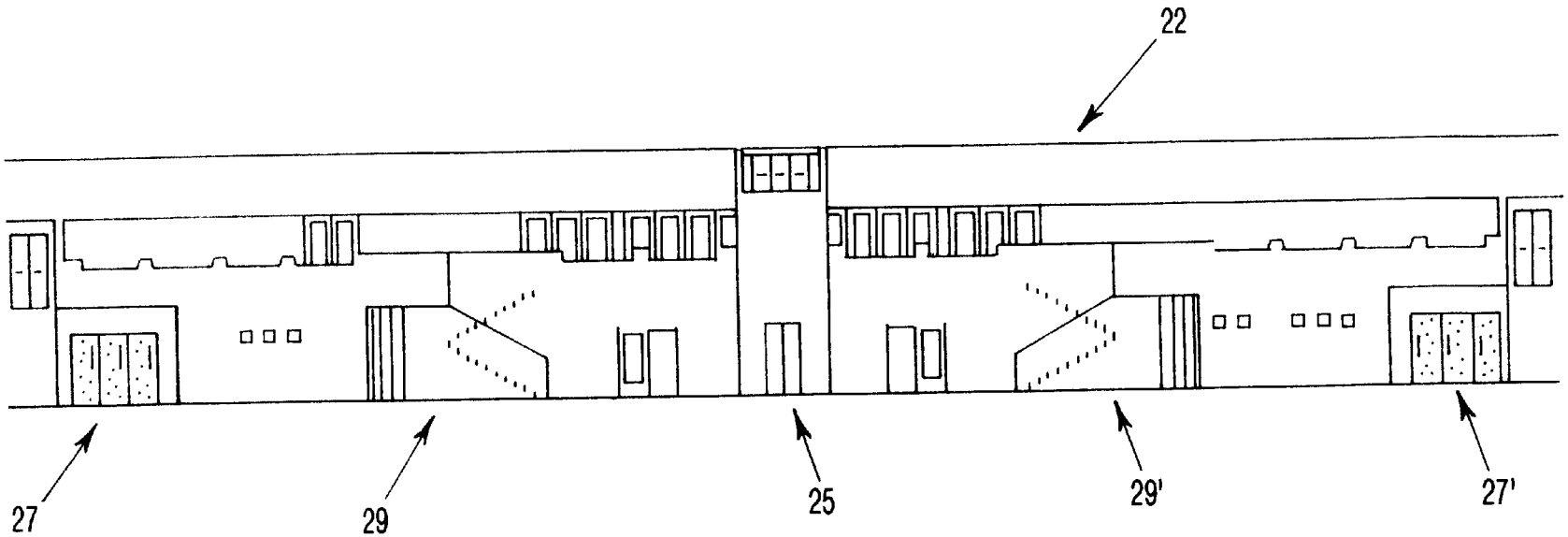
FIG. 6 is a main entrance elevation of the preferred embodiment of the present invention.

An elevation of front main auxiliary entrance structure 22 of the preferred embodiment of recreational facility 10 is shown in FIG. 6. Stairways 29, 29' flank central elevator 25. Further removed from centrally located elevator 25 are doorways 27, 27' for accessing lower level of central module 16 or accessing rinks 12, 12' or accessing corridors 14, 14'. Windows allow viewing into and out of upper level of central module 16.

Figure 7:
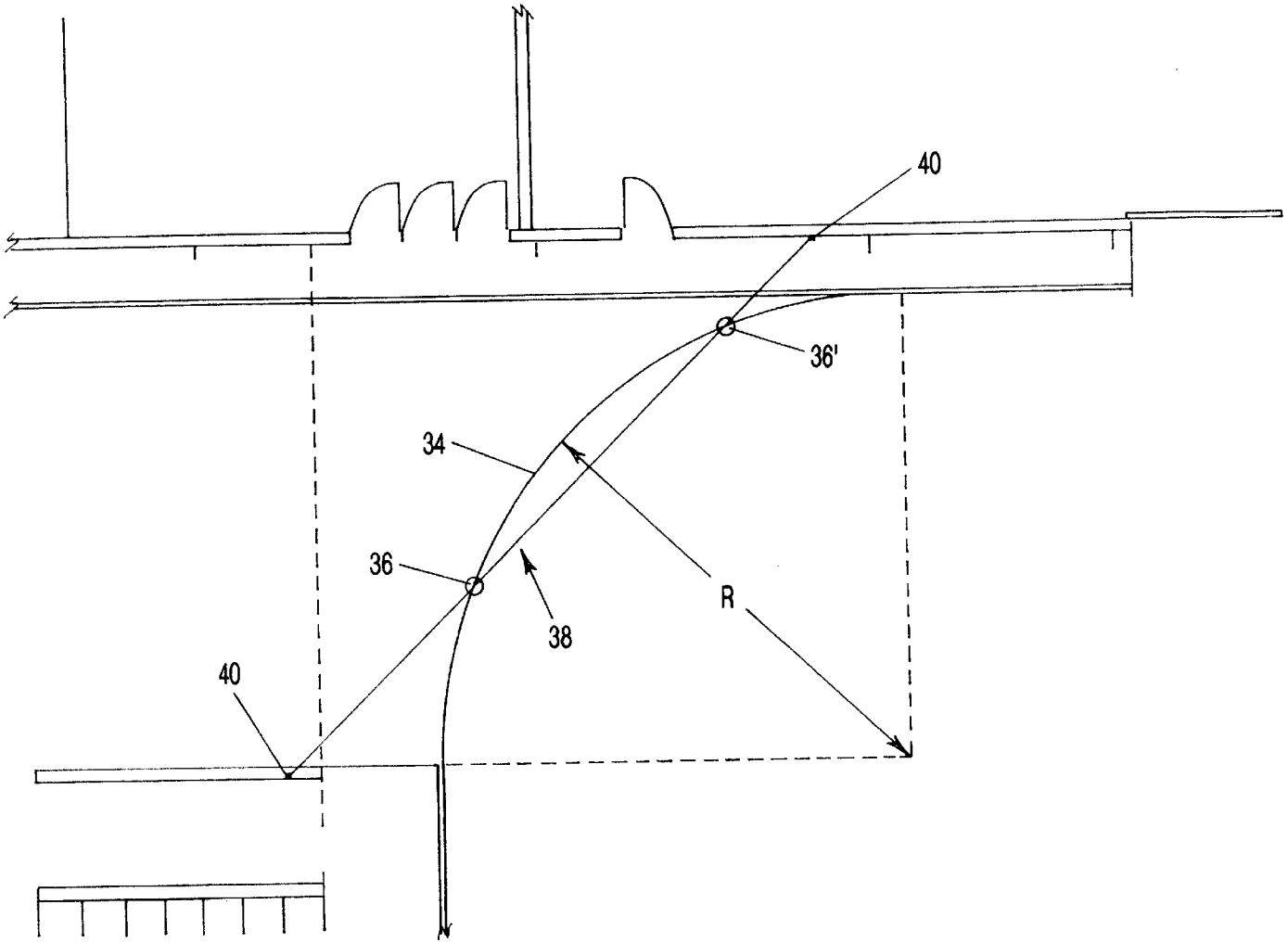
FIG. 7 is a diagram of a dasherboard gate section of the preferred embodiment of the present invention.
Figure 8:
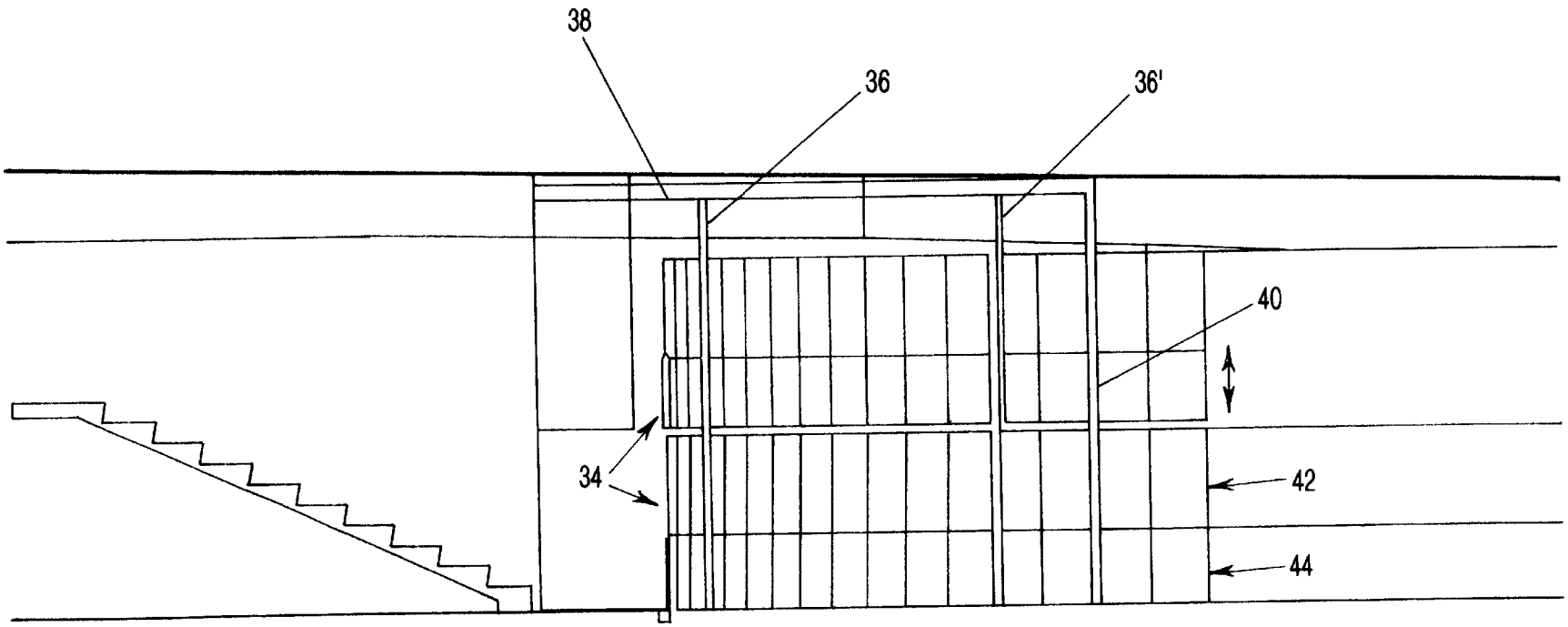
FIG. 8 is a side elevation of the dasherboard gate section of the preferred embodiment of the present invention.

The preferred embodiment of recreational facility 10 comprises movable dasherboard sections 34, 34', 34", 34"'. An overhead diagram of movable dasherboard section 34 appears in FIG. 7. Movable dasherboard section 34 forms an arc with a radius (e.g., 28 feet). Movement of dasherboard 34 occurs through use of a movement means. Movement for dasherboards is accomplished via electrical motors, pneumatics, hydraulic pistons, manual labor, engine power, and the like. Movement is facilitated by cables, gears, wires, wheels, sliding surfaces, folding dasherboards, detachable dasherboards, retracting dasherboards, pistons and the like. FIG. 7 shows movement accomplished by hydraulic pistons 36, 36' connectedly attached to support beam 38. Support beam 38 rests on support columns 40, 40'. A side elevation view of this embodiment appears in FIG. 8. FIG. 8 shows dasherboard 34 comprising upper transparent section 42 and lower section 44. Dasherboards need not carry an upper transparent section, however, such a see-through upper section allows for spectator enjoyment and enhanced observation for training rink users. In ice hockey competitions, an upper translucent section must have integrity to withstand substantial force such as a body impact or a hockey puck.

Figure 9:
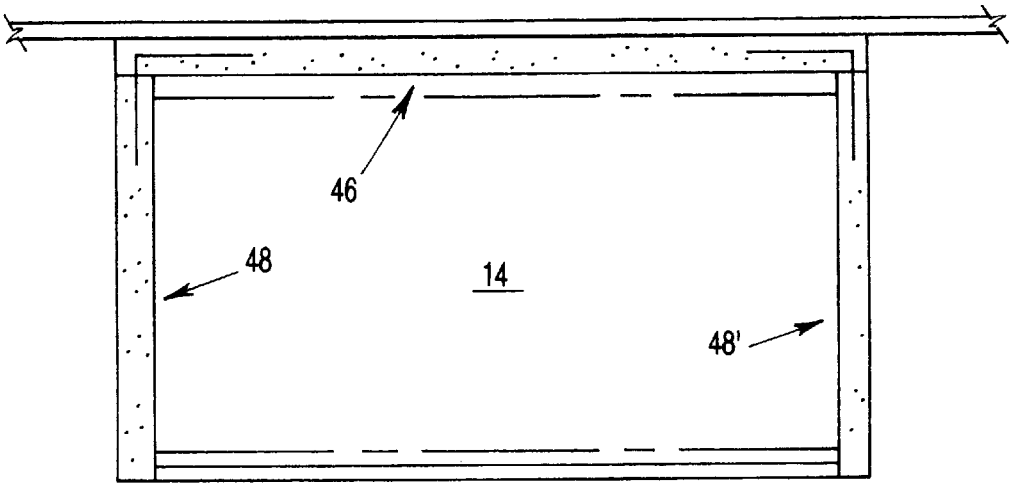
FIG. 9 is a cross sectional view of a corridor of the preferred embodiment of the present invention.

In the preferred embodiment of recreational facility 10, corridors 14 comprise ceilings 46 as shown in FIG. 9. Ceilings 46 are used for the attachment of a variety of equipment including advertisements, festive decorations, scenes (e.g., simulated stellar scenes), instructional equipment (e.g., spotting rigs and runners for spotting rigs), mirrors, lighting, and the like. Corridor walls 48, 48' are adorned similarly, for example, with streaming lights. The corridors can have a variety of cross-sectional shapes including rectangular, circular, oval, polygonal, and the like. Corridors 14 having different cross sectional shapes or corridors 14 with streaming lights create a unique experience for users of recreational facility 10.

Figure 10:
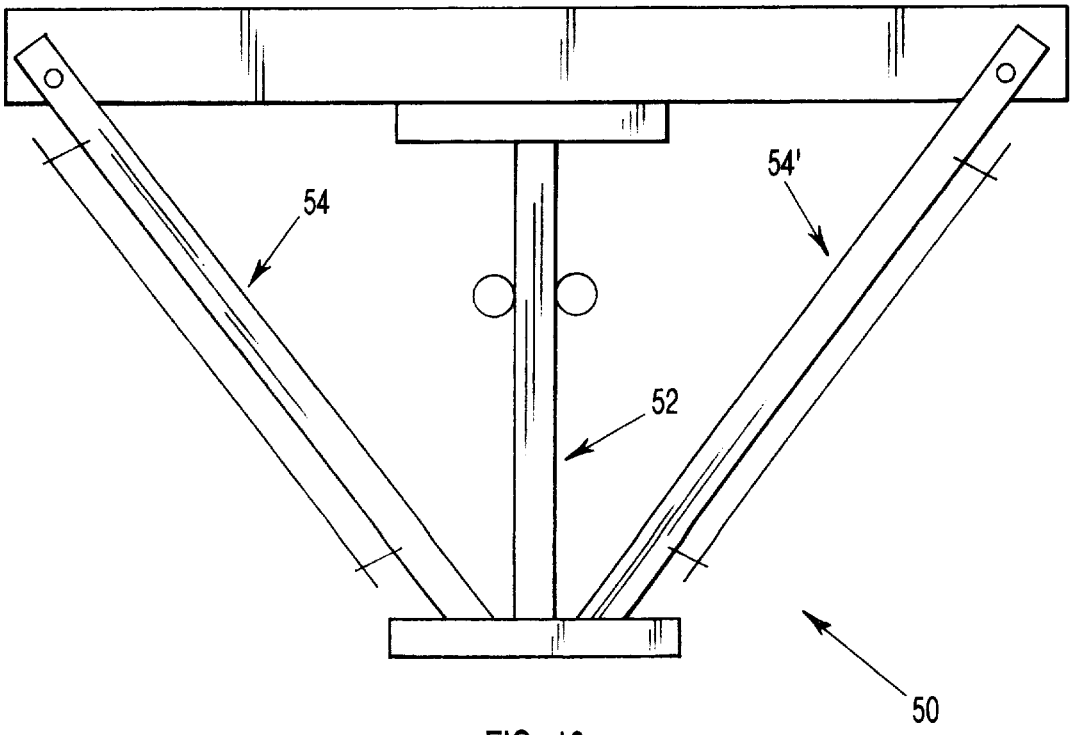
FIG. 10 is a diagram of an advertisement display system of the preferred embodiment of the present invention.

In the preferred embodiment, advertisements are placed throughout recreational facility 10. Girder display system 50, as shown in FIG. 10, enables placement of advertisements. Girder display system 50 comprises central support 52 flanked by angled supports 54, 54'. Lighting units are attachable to central support 52. Self-tapping bolt, self-tapping screws, and the like, secure girder display system 50.

Figure 11:
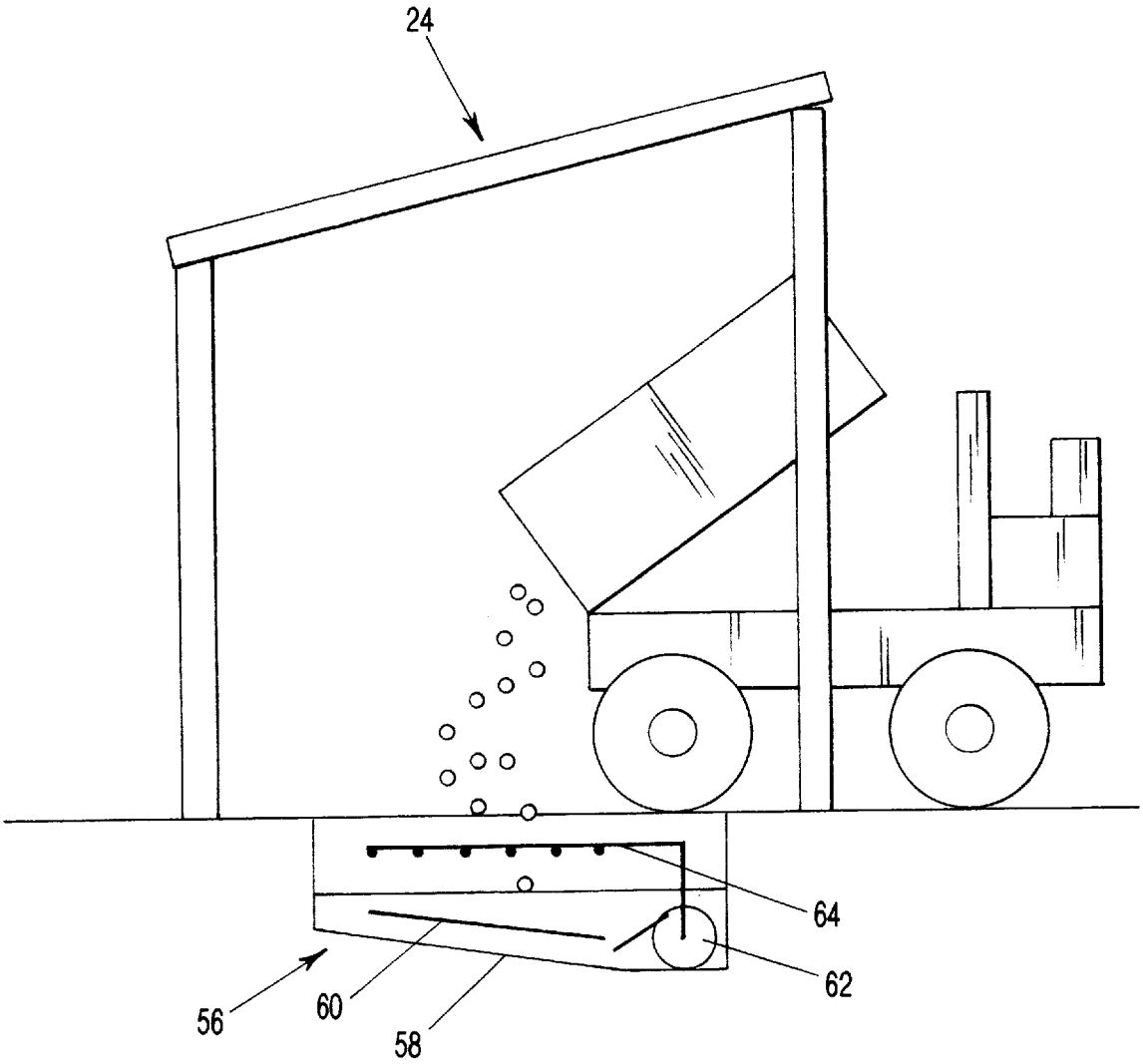
FIG. 11 is a cross sectional view of a Zamboni room with an ice shavings melting system of the preferred embodiment of the present invention.
Figure 12A:
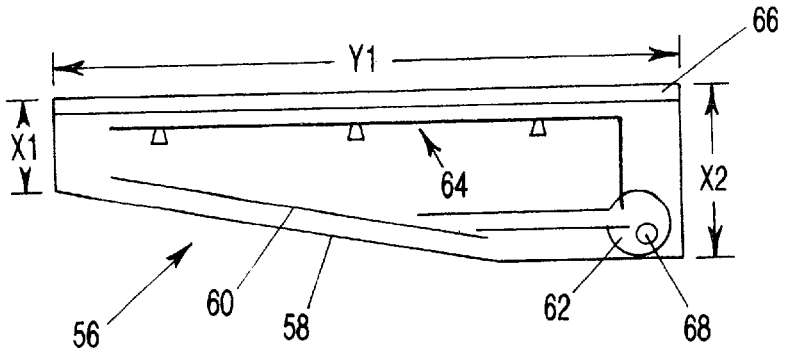
FIG. 12*a* is diagram of a Zamboni room water reclamation system of the preferred embodiment of the present invention.
Figure 12B:
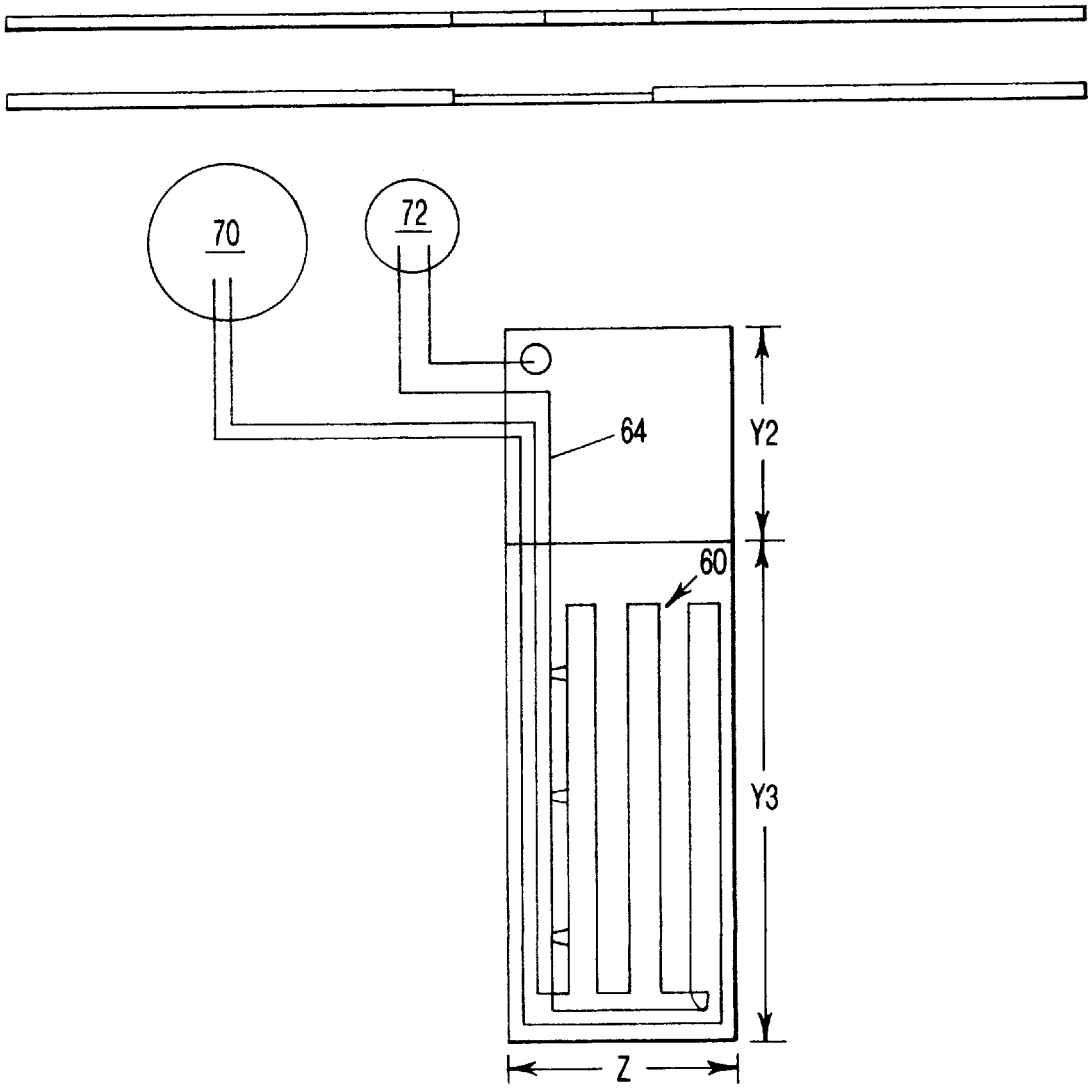
FIG. 12*b* is a cross sectional view of a water reclamation system of the preferred embodiment of the present invention.

In the preferred embodiment, auxiliary structures 24, 24' are used for at least one of the following functions: storage, mechanical room, Zamboni machine room, water reclamation room, dormitory, training room, and the like. Shown in FIG. 11 is an auxiliary structure 24, 24' serving as Zamboni machine room and water reclamation room. The Zamboni machine resurfaces ice surfaces by scraping a layer from the ice and depositing a new layer of water/ice. Ice shavings collected by the Zamboni machine are deposited into melting pit 56. Melting pit 56 comprises a floor 58, heating coils 60, pump 62, and spray system 64. Additional features of melting pit 56 are shown in a cross-sectional view in FIG. 12*a*. Additional features include metal grate 66 and filter pickup 68. An overhead view of melting pit 56 appears in FIG. 12*b*. Additional features of melting pit 56 are shown in FIG. 12*b*, including solar heated water tank 70 and filter unit 72. Solar heating of water occurs preferably via an external solar radiation collector.

Figure 13:
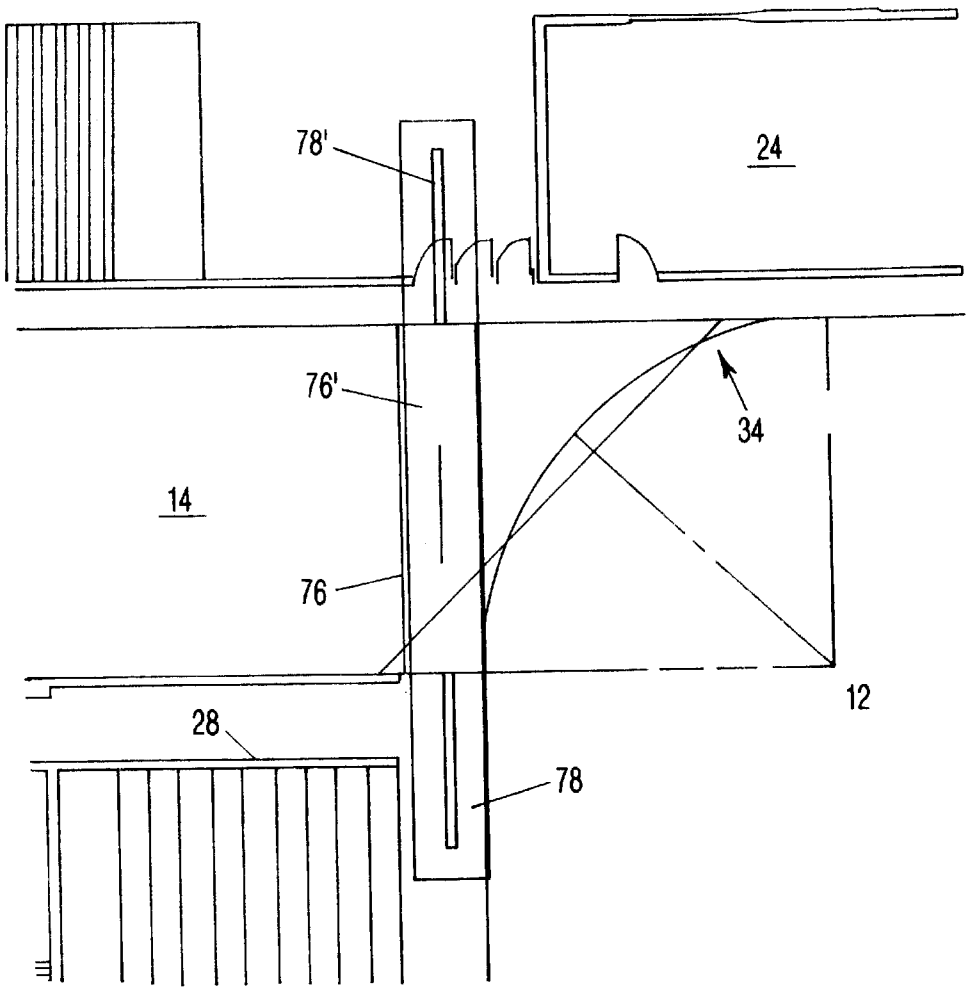
FIG. 13 is a diagram of a movable traversing means of the preferred embodiment of the present invention.

When recreational facility 10 comprises an ice skating facility, additional features are desirable. For instance, when dasherboard gates 20 are closed, a positionable means for traversing corridor 14 is desirable. FIG. 13 shows a preferred embodiment of recreational facility 10 and positionable means 74 for traversing corridor 14. Positionable means 74 comprises two slidable walkway sections 76, 76'. Slidable walkway sections 76, 76' move between open and closed positions by hydraulic pistons 78, 78', or similar mechanical, pneumatic, electrical devices, and the like. An alternative embodiment uses elevated walkways to traverse corridors.

Figure 14:
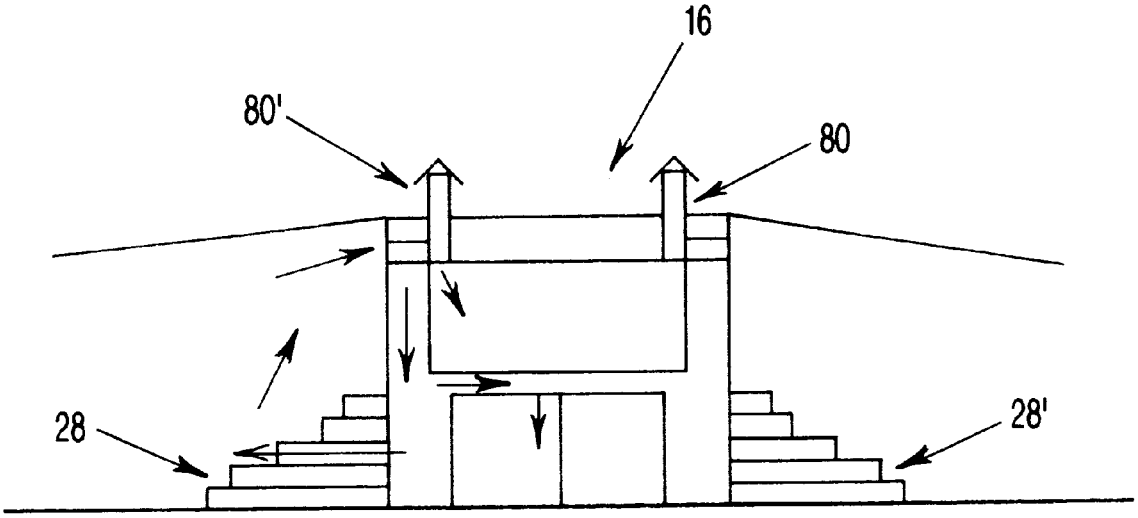
FIG. 14 is a cross sectional view of a central module of the preferred embodiment of the present invention showing airflow for heating and cooling.

Temperature control in central module 16 and seating areas 28, 28' preferably relies on circulating air. A preferred embodiment of a circulating air system of recreational facility 10 is shown in FIG. 14. Air enters central module 16 through air handlers 80, 80'. Air enters air handlers 80, 80' from outside and from above seating areas 28, 28'. Air exits air handlers 80, 80' passing through various routes in central module 16. For multiple story central module configurations, air from air handlers 80, 80' passes through all levels. Convection currents aid airflow, which forms an air-tempered mushroom or tee zone. Heating of air when necessary occurs through a hot water heat exchange system. In warmer environments where recreational facility 10 comprises ice rinks, the airflow pattern facilitates cooling of central module 16.

The present invention answers problems associated with rink-based recreational facilities, especially ice skating rinks, including limited skating surface, competing skating venues, skating entertainment value, and the general economic well-being of ice arenas. The present invention uses in its most basic and preferred configuration, two regulation size arenas positioned side by side connected at their corners by two ice paths (e.g., about 16' wide by about 130' long). This creates four ice surfaces or ice sheets separated by movable gates at the inside corners of the main ice sheets. When the gates are closed, four individual ice surfaces are available for use, and each may serve a different purpose or support a different venue, e.g., recreational ice skating, figure skating, or hockey. When the gates are open, an ice oval (e.g., about 0.2 mile to about 0.25 mile) is created; however, other configurations create shorter or longer loops.

The main advantage of this enlarged skating area is public enjoyment. The large oval offers a much more intricate skating pattern with greater interaction between the skaters and the surrounding environment. It also opens the door to another Olympic venue, speed skating.

To further add to the invention's public appeal, the outer wall in both arenas may be facade-decorated, e.g., in an authentic antique mode depicting the multi-cultural heritage of the surrounding area. For example, a sleepy adobe rural town may be depicted in one arena, with a cliff dwelling depicted in the other. As another example, the ice corridor, which creates the link between the two main ice sheets, may be decorated with murals of snowclad evergreens giving the appearance of two rivers (ice paths) connecting two lakes (arenas).

During the fall and winter months, Thanksgiving to mid-January, holiday lighting and decorations may enhance this theme park mode. For example, Christmas trees, in each arena, decorated with presents underneath, may be in the rink or within the decorative area. A gas-log fireplace may be lit in the middle of the lobby. This creates a unique, warm, enjoyable holiday atmosphere, which increases the popularity of both ice skating and the arena of the present invention.

The design and construction of the facility of the present invention, may utilize a manufactured steel frame building with cement masonry unit, or precast concrete walls and a sheet metal standing seam roof, or the like. All of the product components involved in this type of construction are standard to the metal building and general construction industry and are inexpensive and readily available. The nature of ice arena activities is such that an unsophisticated but extremely durable outer building shell is desirable. Repainting the outer surface of this type of shell renews the appearance. This provides savings in architectural and construction costs.

The outer shell is preferably insulated (e.g., filling open cells of CMUs or precast panels with polystyrene beads). The roof may be insulated (e.g., with about 12 inches of fiberglass bar insulation backed on the upper side with reinforced vinyl and on the lower side with reinforced aluminum material). It is desirable to have the inside surface, the arena ceiling, covered with a reflective material for low emissivity.

The roof may be an aluminum or metallic color, if possible, so as to reflect the maximum amount of heat outward. The next most desirable roof color is white or buff if a metallic color is aesthetically objectionable.

The pitch of the roof of this kind of structure is varied from locale to locale to achieve proper engineering design for each area and climate. This pitch can be masked from view by the outer walls or exposed if desired.

Multiple steel frame buildings linked together form a flexible configuration for increasing or decreasing building size. In the preferred embodiment, the frame accommodates various size arenas, e.g., rinks from about 85' to about 100' wide, corridors from about 110' to about 150' long, and central modules with a lobby area from about 50' to about 100' per side. These parameters enable a facility to fit the budget economics and demographics of a proposed area, i.e., smaller facilities configured for smaller demographic justifications and larger ones for larger market areas.

The basic configuration of the recreational facility building of the preferred embodiment comprises multiple steel building frames linked together. The primary building comprises a central two-story, rectangular module, e.g., at least about 70' wide by at least about 200' long. The upper level functions as spectator, entertainment, food service, office areas, and the like, the lower level houses dedicated athletic facilities, such as locker rooms, showers, weight rooms, employee lounges, rental lockers, retail proshop, gift shop, and the like. Restrooms are preferably located on both levels.

In the preferred embodiment, two rink modules are linked lengthwise to the central module (e.g., from about 20' to about 25' minimum in height, and at least about 200' long by about 130' in width). Girder bay spacing may vary, e.g., about 25' for a 200' length building or about 30' for a longer building. These two modules are expandable in length and width to accommodate the dimensions of an Olympic-size ice sheet or additional end seating. Seating of stacked precast concrete tees are supported on, e.g., four 4 monolithically poured, stepped, abutments along the central module in each arena module. Steps (e.g., concrete) in aisleways may be added or two-way escalators are installable for access to the upper entertainment level. An ideal combination has two aisleways with steps and two escalators.

Also in the preferred embodiment, two ice corridors are in line with the end of the arenas, extend from the inner rink corners, and pass under and through the central module to connect with the corner of the other arena at each end of the central module. These corridors are, e.g., from about 16' to about 28' in width and from about 130' to about 160' in length. When the automatic dasherboard corner gates are raised in each inside arena corner, the two arenas are linked together forming a continuous ice loop.

In the preferred embodiment, dasherboards run continuously between the two rink areas through the corridors. At the point of tangency with the rink radius, or that point where the rink dasherboard gate section would interfere with the corridor dasherboard extension (the "hook-up point"), a section (e.g., about 3') of the terminal end of the corridor dasherboard is movable so that it can be positioned out of the way of the descending dasherboard gate. This section, when open, serves as a gate to the other side of the arena or bench-scores table area. When the dasherboard gates are in the open, the corridor extension gates are closed to fill in the continuous arena dasherboard surrounding the large ice loop.

Also in the preferred embodiment, movable dasherboard gate sections which sit on top of the ice sheets are manufactured shorter (e.g., about 2" to about 3") than the other sections of the dasherboard. Other stationary sections of the dasherboard are positioned in the ice. So that the top rail of the curved movable dasherboard sections are flush with the top rail of the stationary sections, the curved section must be shorter. A plastic base plate is added to the base of the curved dasherboard gate. This plastic material (e.g., hydrophobic) does not allow water to freeze to it. Alternatively, the base plate may be heated to free it from an ice surface.

In an alternative embodiment, the dasherboard gate sections are removable manually by attendants in multiple sections and stored adjacent to the passageways where space is available. In the preferred embodiment, the dasherboard gates are lifted straight overhead into the ceiling space. This can be done in several ways including by an electrical motor, gear driven, spindle mounted cable system; an electric motor, gear driven, rolling pipe cable system; or a hydraulic ram.

It is preferable to lift the corner gates from overhead so as to leave as much of the ice below unobstructed. These systems are preferably automated and operate from the push of a button. The preferred systems have no difficulty lifting standard arena wall designs (e.g., from about 3" to about 6" thick), that normally weigh between about 35 pounds and about 50 pounds to the lineal foot. A hydraulic ram system is desirable since the wall can be placed very positively in the same place each time and operation is quiet. Carefully engineered pickup points balance the load, thereby stabilizing the wall during the lifting operation.

In the preferred embodiment, the front entry module is a lean-to steel structure, one story in height located at the front of the central module. The top of this structure is a waterproofed open air deck addressing a solid glass entry wall, which consists of a theatre style double ticket booth with doors right and left for entry into the lobby area. The upper level is reached by staircase at either end of the entry module. Centered between the staircases is a small elevator for freight deliveries and for convenience of the disabled. Underneath the upper deck is office space for the events office where customers may sign up for programs, buy tickets, make reservations, and the like. The back wall of this office area has a large one way glass window so that skaters passing through the tunnel can be seen by the prospective customers, giving the new customer an incentive to participate. At either end of the front entry module and separated from it by emergency doors, both right and left, are two lean-to buildings which house e.g. retail shop space for proshop, health items, memorabilia gift shop, exercise studio and the like. These lean-tos affix to the end of each of the arena modules. Ground level and frontal location of this space facilitates customer convenience when shopping.

In the preferred embodiment, Zamboni and mechanical rooms are lean-to type steel building additions similar to the retail space modules that are located at the rear of each arena module. They are located where water, gas and electrical power are available. These lean-tos are e.g., about 20' wide by at least about 70' to about 110' long. The mechanical room contains the boiler for hot water heating and a dehumidifying unit where required. The Zamboni room preferably has two large garage style doors, one leading to the outside and one opening into the arena. These doors are directly across from each other and a water reclamation pit (e.g., about 4' wide by about 15' long) for melting and reusing arena snow or ice shavings is located between them.

Both the retail space module and the utilitarian module are configurable with two stories in height if additional space is needed to accommodate storage, meeting and party rooms, and the like. Where necessary, the second story may be used as a dormitory for visiting skaters, teams, and the like.

As both modules of the preferred embodiment are located at the ends of the arenas, they are preferably oriented either South or West so as to function as dead air space to shield the arenas from solar radiation and heat gain. The facility is buildable on a flat lot or if buildable against the side of a hill, flush against one or two sides, about four feet down or half basement. All of these building orientation specifications are peculiar to the site selected. Flush fitting sides are especially beneficial on the West and South elevations to prevent heat gain. Recessing the arenas and central athletic facilities into the ground as a basement also prevents heat gain. Each of these design considerations is weighed against fire code requirements for type of construction and the need for sprinkling when the design qualifies as a true basement.

Two separate manifold systems in the preferred embodiment emanate from the center of the arena to each end, one serving the arena ice sheets and the other serving the ice sheets in the corridors. Each manifold system has a feed and return pipe. Ice systems with dry condensers are located at the outside corners of each Zamboni room. A desuperheater captures excess heat and transfers it to the HVAC water storage tank to supplement hot water heating. A refrigeration system made up of multiple small horsepower reciprocating type compressors, e.g., about 50 HP or less each, or a screw type compressor system is used to chill the arena ice. This lends itself to a more flexible ability to cycle downward or upward to decrease electrical consumption and provide the optimum amount of cooling when needed. This also provides a high degree of backup should any compressor experience problems.

In the preferred embodiment a natural gas fired boiler that supplies hot water to a storage tank (e.g., about 500 gallon) in the mechanical room located next to the Zamboni room. This system is supplemented by a solar heating system using an array of solar panels located on the roof, e.g., from about at least 15 panels having dimensions about 3'×8'. A desuperheater is employed to capture the heat generated by the ice system compressors just prior to the excess heat being delivered to the condenser. This heat transferred through the desuperheater to the solar hot water loop further supplements the heating process, thereby saving natural gas.

In the preferred embodiment the need for an air conditioning system is minimized since the central module is located between the rinks and corridors. The rinks and corridors create cold zones that can be used to cool the central module. Mechanically adjustable vents allow cold zone air to circulate with air from the air handler thereby cooling the air circulating through the central module.

In the preferred embodiment, decreased water consumption is facilitated by a water reclamation system consisting of a concrete pit in the Zamboni room where ice shavings collected by the Zamboni machine from cleaning the ice sheet are deposited. The ice shavings are melted down with hot water heat provided by a heat coil at the bottom of the pit and then filtered through a filter (e.g. standard swimming pool filter system). The pit is preferably about 4' wide by about 15' long and at its deepest point is about 4' deep. At one end there is a level floor or sump area (e.g., about 4' square) where the water pick-up is made. The other end of the pit slopes down to the sump area, e.g., from about 30" deep to about 4' deep at the sump area. The heat coil is on the sloped bottom surface. The snow or ice shavings are dumped out of the Zamboni machine onto the sloped surface. The recirculating filter-pump delivers a some of the water (e.g., about 50%) back to the Zamboni machine for re-use and the remainder to the pit through multiple spray nozzles located intermittently along the full length of the pit. The spray recirculation system accelerates the melting process. Before the next run, the tanks on the Zamboni machine are filled with clean water by this process and the ice shavings are melted. A demineralizing (reverse osmosis) system can be added to this loop if desired.

The refrigeration systems used in the facility preferably uses hydrofluorocarbon gas, e.g., Dupont AC9000, or equivalent that is non-destructive to the ozone layer. This is indirect system using propylene glycol as a heat transfer fluid under the arena surface. Propylene glycol is relatively safe and non-toxic.

Consumption of water is held to a minimum by the water reclamation system described above. Water consumption can be cut (e.g., about 75%) with the only loss being to filter flushing, minor spillage or evaporation. This is beneficial to both community and business economics.

In the preferred embodiment, the arenas are designed and constructed to meet international and USA specifications for both figure skating and hockey. The ice is stripped and marked appropriately. When the dasherboard corner gates and nets are in place, they can host figure skating competitions or hockey tournaments for all age brackets, male, female or coed on a local, regional, national or international level. When the corner gates are open, the arenas can be used for speed skating training and competition.

Also in the preferred embodiment, each arena is equipped with a scoreboard with a main time clock and e.g. four penalty time clocks. On the side of the arena that is across from the seating area are opposing team benches, penalty benches and central scorers' table. The scorers' table is preferably protected by a glass surround. The scorers table area is preferably equipped with public address facilities and a keyboard controller for the scoreboard.

In the preferred embodiment, the corridors are operable, when open, in a one-way direction, preferably with arrow lights at their entrances and ends indicating the proper skating direction. These arrow lights are preferably reversible by supervisory personnel. Before reversing the direction, rink personnel by the public address system asks everyone to come to a complete stop. A video surveillance system with monitors in the upper level observation booths staffed by arena personnel allows the arena personnel to know when everyone is completely stopped. The reversal of directions is only announced when everyone has stopped. Corridors are well lighted and multiple video cameras monitor skater conduct. Skating ice guards are summoned to the vicinity of misconduct for appropriate disciplinary action. There are public address, music and video surveillance systems in both arenas. These systems are controlled from two observation booths located on the upper level at center ice with a full view of the ice sheet below. Ice guards and lobby security personnel are equipped with two-way radios or other communication devices so that they may respond to any call for assistance or emergency. The lobby and management offices on the upper level have a view through tempered glass windows of the entire arena. Customers and personnel watching the arena serve as a natural warning system to prevent problems before they develop. The corridors are monitored by video cameras and ice guards. Card-access door locks secure the lower level of the central module and only card carrying authorized persons may access these areas.

In an alternative embodiment, during lesser crowded skating sessions, a mock sleigh with reindeer, e.g. capable of carrying four passengers and an operator, powered by a battery and electric motor, belt or cleated tire driven, may give rides to skaters and nonskaters. These are slow leisurely rides carefully blending with the skaters. The sleigh is adequately padded without sharp edges to avoid injuries caused by collisions.

The preceding examples can be repeated with similar success by substituting the generically or specifically described equipment, configurations, devices and/or operating conditions of this invention for those used in the preceding examples.

In particular, the preferred example and embodiment is directed to an ice skating facility, but the facility can be easily adjusted to use for roller skating, swimming, etc., as mentioned above.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A facility for recreation comprising:

at least two rinks comprising surfaces;

at least one corridor comprising surfaces, said corridor connecting said rinks, wherein said corridor comprises a length greater than approximately one half the length of one of said rinks, and wherein said corridor comprises a connectively separatable recreation surface; and a central module bordered by at least two of said rinks and at least one of said corridors, wherein said central module comprises at least two levels and at least one of said levels extends over at least one of said corridors.

2. The facility of claim 1 wherein said surfaces comprise at least one surface selected from the group consisting of water, ice, snow, flooring, natural materials, synthesized materials, and manufactured materials.

3. The facility of claim 1 wherein said rinks comprise at least one configuration selected from the group consisting of a rectangle, circle, oval, square, and polygon.

4. The facility of claim 1 wherein said corridor comprises a length between approximately 110–160 feet.

5. The facility of claim 4 wherein said corridor comprises a length of approximately 130 feet.

6. The facility of claim 1 wherein said corridor comprises a width of approximately 16 feet.

7. The facility of claim 1 wherein said corridor comprises a location for training skill devices.

8. The facility of claim 7 wherein said location for training skill devices comprise at least one training skill device selected from the group consisting of spotting belts, harnesses, runners, spotting rigs, foam pits, water pits, cushioned pits, video cameras, tracks, mechanical arms, and ropes.

9. The facility of claim 1 wherein said central module comprises at least one access to at least one component of the facility for recreation, said facility comprising at least two rinks and at least one long corridor connecting said rinks.

10. The facility of claim 9 wherein said access comprises at least one member selected from the group consisting of a stairway, an escalator, an elevator, a ramp, and a pole.

11. The facility of claim 1 further comprising an upper level lobby, said lobby comprising an entry to the upper level of said module.

12. The facility of claim 1 wherein said central module comprises at least one room selected from the group consisting of a lobby, a locker room, a concessions area, a coat check room, an emergency aid room, a training room, a restroom, a storage room, a fireplace room, a viewing room, an office, an instructional room, a theatre, an audiovisual room, a music room, a meditation room, a sauna, a fitness center, a steam room, a kitchen, a dining room, a dormitory room, a laundry room, a supply room, a ticket booth, a telephone booth, a communications room, a computer room, and an autograph room.

13. A facility for recreation comprising:

at least two rinks comprising surfaces;

at least one corridor comprising surfaces, said corridor connectedly separable from said rinks, and wherein said corridor comprises a length greater than approximately one half the length of one of said rinks; and a central module bordered by at least two of said rinks and at least one corridor, said central module comprising at least two levels and at least one opening to at least one member of the recreational facility, wherein one level extends over at least one corridor of said recreational facility.

14. The facility of claim 13 wherein said corridor comprises a length between approximately 110–160 feet.

15. The facility of claim 14 wherein said corridor comprises a length of approximately 130 feet.

16. The facility of claim 13 wherein said corridor comprises a width of approximately 16 feet.

17. The facility of claim 13 wherein said corridor comprises a location for training skill devices.

18. The facility of claim 17 wherein said location for training skill devices comprise at least one training skill device selected from the group consisting of spotting belts, harnesses, runners, spotting rigs, foam pits, water pits, cushioned pits, video cameras, tracks, mechanical arms, and ropes.

19. The facility of claim 13 further comprising an upper level lobby, said lobby comprising an entry to the upper level of said central module.

* * * * *